US005160036A

United States Patent [19]

Childers

[11] Patent Number: 5,160,036

[45] Date of Patent: Nov. 3, 1992

[54] AUTOMATIC POLLUTION CONTAINMENT AND ALERT APPARATUS FOR LIQUID DRAINAGES

[75] Inventor: Charles P. Childers, cody, Wyo.

[73] Assignee: Marathon Oil Company, Findlay, Ohio

[21] Appl. No.: 777,822

[22] Filed: Oct. 15, 1991

[51] Int. Cl.[5] ..... E02B 1/00

[52] U.S. Cl. ..... 210/85; 136/291; 210/96.1; 210/154; 210/170; 405/37; 405/80; 405/107; 73/61.43; 73/61.46

[58] Field of Search ..... 210/85, 94, 96.1, 170, 210/248, 153, 154, 747; 405/37, 92, 101, 107, 108, 52; 73/61.41-61.48; 136/291

[56] References Cited

U.S. PATENT DOCUMENTS

| | | | |
|---|---|---|---|
| 3,850,807 | 11/1974 | Jones | 210/170 |
| 4,319,998 | 3/1982 | Anderson | 210/86 |
| 5,067,850 | 11/1991 | Gray | 210/170 |

FOREIGN PATENT DOCUMENTS

| | | | |
|---|---|---|---|
| 2377483 | 9/1978 | France | 405/37 |
| 60-70210 | 4/1985 | Japan | 405/92 |
| 2-296922 | 12/1990 | Japan | 405/37 |
| 1067133 | 1/1984 | U.S.S.R. | 405/108 |
| 1114730 | 9/1984 | U.S.S.R. | 405/108 |

*Primary Examiner*—Mary Lynn Theisen
*Assistant Examiner*—Joseph Drodge
*Attorney, Agent, or Firm*—Jack L. Hummel; Jack E. Ebel

[57] ABSTRACT

An apparatus for containing liquids and pollution within a liquid drainage comprising a first conduit, a second conduit, a liquid barrier, a means for lifting, and a means for sensing pollution. The second conduit is smaller in relative diameter than the first conduit and is positioned so that the second conduit outlet end is located within the first conduit. The second conduit has a flexible portion of its length which permits the outlet end of the second conduit to be lifted while the inlet end of the second conduit remains stationary. The liquid barrier guides fluid flow into the second conduit inlet during normal flow, guides fluid flow into the second conduit and liquid flow over the top of the liquid barrier and into the first conduit during floods and retains liquid during normal flow when the outlet end of the second conduit is lifted. The apparatus further comprises a means for lifting which is electrically connected to a sensing means. The sensing means detects pollution, and activates the lifting means to lift the outlet end of the second conduit means causing the liquid barrier to retain liquid. The lifting means is adjustable so that the height that the outlet of the second conduit is lifted is predetermined allowing either a temporary or substantially permanent interruption of drainage liquid flow. Finally, the apparatus is comprised of an audio and/or a visual alarm, sounded when the sensing means senses pollution, which alerts personnel that pollution is detected in the drainage.

14 Claims, 5 Drawing Sheets

AUTOMATIC POLLUTION CONTAINMENT AND ALERT APPARATUS FOR LIQUID DRAINAGES

BACKGROUND OF INVENTION

1. FIELD OF THE INVENTION

The present invention relates to an apparatus for containing pollution within liquid drainages.

2. DESCRIPTION OF RELATED ART

Awareness of environmental pollution and increased governmental regulation of pollution sources has spurred a need for ways to restrain pollution from spreading once pollution has entered into liquid drainages. Such pollution can be oil products floating on water, emulsions, solids floating on or suspended in liquids, high or low pH materials, high or low temperature materials, liquid materials alone or mixed with water or any materials that are undesirable to have continue traveling down a liquid drainage.

U.S. Pat. No. 3,850,807 to Jones discloses using a combination oil accumulator-separator floated on a stream to contain and clean-up oil spills. The accumulator-separator is held in the middle of the stream and to both banks by floating vertical barriers. The stream current which is guided by the vertical barriers carries the floating oil plus some water off the top of the stream onto the throat of the oil accumulator-separator. The separator contains a bed of granular sulfur supported by a perforated plate. The supporting plate has nonperforated or protected channels. The oily water flows through the sulfur bed where the oil is coalesced and concentrated. As the water and coalesced oil flows out the lower perforations, the oil seeks the protection of the channels. The channels are tilted upwardly in a downstream direction toward a collecting conduit which is connected to a pump. The coalesced oil is removed by the pump and the oil-free water flows downward and out the perforations of the plate and again becomes a part of the main flow of the stream. U.S. Pat. No. 3,850,807 is primarily a device to remove oil from a stream once someone has discovered that a spill has occurred. However, this apparatus does not prevent all the oil from flowing downstream since some oil will escape while the apparatus is put in place on the stream. Ideally, an apparatus is needed which is capable of detecting the presence of pollution in a drainage, containing all the pollution before it proceeds downstream within the drainage and alerting personnel that pollution is being contained so that remediation measures can be enacted.

An attempt to create an alert device is disclosed by Anderson in U.S. Pat. No. 4,319,998. Anderson discloses a monitor for an effluent disposal system for preventing suspended solids in an effluent from clogging a disposal field. A separate monitor housing having an inlet and an outlet is installed in the piping interconnecting a septic tank and a disposal field. A screening system in the housing screens out suspended solids. As the solids accumulate on the screening system over a period of time, the fluid level rises, actuating a float operated switch connected to a means to signal that the system needs servicing. U.S. Pat. No. 4,319,998 is useful for screening out suspended solids in a sewage disposal system and alerting that the system needs servicing but is not well suited to monitoring for, and containing, non-suspended solid pollution sources in a liquid drainage.

Thus, a need exists for an apparatus which can be left in place on a liquid drainage and which will monitor the drainage for the presence of pollution. A need also exists for an apparatus capable of containing pollution once it has been detected in the drainage and for an apparatus which is capable of alerting personnel that pollution source is being contained so that those alerted can enact remediation measures.

Finally, in some instances it is not practical nor is it legal to permanently interrupt fluid flows. If the volume of liquid flow is relatively large, the upstream area required to contain a spill needs to be very large. Damming is not practical if the upstream containment volume is inadequate to contain the entire liquid flow. It also may be illegal to completely stop liquid flow on some streams and rivers due to state and federal laws. Therefore, a need exists for an automatic pollution containment apparatus which is capable of temporarily interrupting liquid flow while simultaneously containing the pollution, then resuming liquid flow once the pollution is contained.

Accordingly, it is an object of the present invention to provide an automatic pollution containment and alert apparatus which is capable of sensing pollution upstream of the containment apparatus and containing the pollution within the drainage in response to the sensing while alerting personnel that pollution remediation measures need to be enacted.

It is also an object of the present invention to provide an automatic pollution containment and alert apparatus which optionally can be preset to simultaneously contain pollution yet still allow a liquid flow to continue or optionally be preset to completely shut off all liquid flow.

SUMMARY OF INVENTION

To achieve the foregoing objects, and in accordance with the purposes of the present invention, as embodied and broadly described herein, the present invention is an apparatus comprised of a first conduit for conveying liquid, a second conduit with a liquid outlet positioned within the first conduit and a liquid inlet, a liquid barrier connected to the first conduit for temporarily restraining and for guiding liquid, a means for sensing pollution and a means for lifting the outlet of the second conduit in response to activation by a means for sensing pollution. The second conduit is relatively smaller in diameter than the first conduit and the second conduit has a flexible portion which enables the second conduit to be raised while the second conduit inlet remains substantially stationary. During normal liquid flow, the liquid barrier guides liquid into the second conduit and during floods, the liquid barrier guides liquid over the top of the liquid barrier, into the first conduit while simultaneously guiding liquid into the second conduit. The liquid barrier also restrains liquid when the second conduit outlet is lifted by the lifting means. The lifting means is comprised of a an electronic controller for receiving an activation signal from the sensing means, a solenoid latch, a cogwheel, a coil spring attached to the winch, and a shaft on which is mounted the cogwheel, winch and coil spring. The lifting means is further comprised of an alarm electronically connected to and powered by the controller, a battery electronically connected to the controller for powering the controller, a solar charger electrically connected to the battery for charging the battery, a flexible connector attached at one end to the winch and attached at the other end to the outlet of the second conduit and a solenoid latch electrically connected to and powered by the controller. The solenoid latch has a retractable pin positioned to engage the cogwheel when the pin is extended and positioned to disengage from the cogwheel when the pin is retracted. A housing covers the solar charged battery, cogwheel, solenoid latch and shaft, outside of which are positioned the solar charger and the alarm. The means for lifting is adjustable to lift the second conduit to a height less than, equal to or greater than the height of the liquid barrier. The means for sensing pollution is positioned upstream relative to the means for lifting and is capable of, but is not limited to, sensing for hydrocarbons, pH, liquids and/or temperature.

BRIEF DESCRIPTION OF THE DRAWINGS

The accompanying drawings which are incorporated in and form a part of the specification, illustrate the embodiments of the present invention and together with the description serve to explain the principles of the invention.

In the drawings.

DESCRIPTION OF THE PREFERRED EMBODIMENTS

The present invention is described in the context of specific terms which are defined as follows. "Pollution" is any material that is desired to be prevented from flowing down a liquid drainage. "Liquid drainage" is any area through which liquid will flow by force of gravity from a relatively high elevation to a relatively low elevation and includes, but is not limited to ditches, channels, canals, streams, pipes, and conduits. "Liquid barrier" is any means for temporarily restraining and for guiding liquid and includes but is not limited to dams, levees, dikes, spillways, and berms. "Flood" is descriptive of any condition in which the total volumetric liquid flow through the drainage exceeds the maximum volumetric liquid flow capacity of the second conduit causing liquid levels to rise behind the fluid barrier and eventually overflow the fluid barrier. "Normal flow" is descriptive of the condition in which the total volumetric liquid flow through the liquid drainage does not exceed the maximum volumetric liquid flow capacity of the second conduit. "First conduit" is any natural or artificial passageway through which liquid flows. It is inclusive of but not limited to closed structures such as pipes, tubes and culverts and open structures such as ditches, channels and canals. "Second conduit" is any artificial passageway through which liquid flows. It is inclusive of but not limited to closed structures such as pipes, tubes or culverts.

Figure 1:
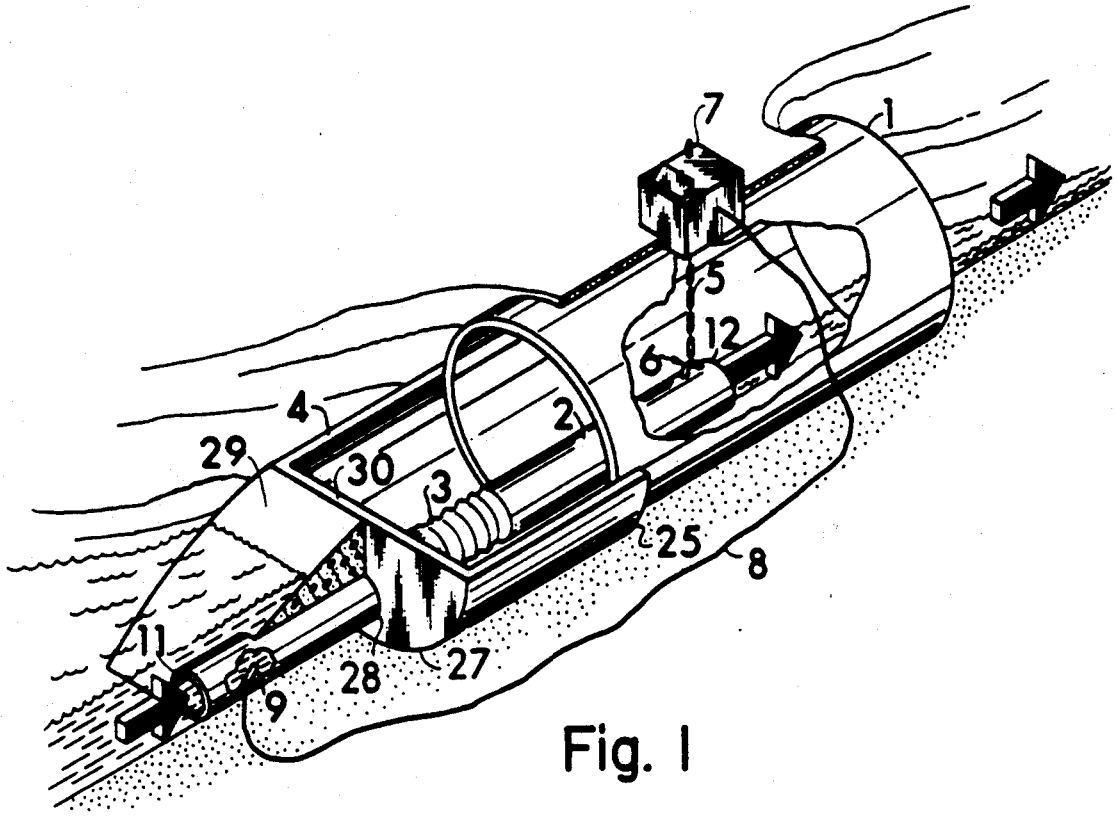
FIG. 1 is a perspective view of a culvert type automatic pollution containment and alert apparatus.

Referring to FIG. 1, the automatic pollution containment and alert apparatus of the present invention comprises a first conduit 1 for conveying liquid and a second conduit 2 having a portion thereof positioned within the first conduit 1. The second conduit 2 is smaller in relative diameter than the first conduit 1. The second conduit 2 has a flexible portion 3 which allows the outlet 12 of second conduit 2, positioned within first conduit 1, to be raised and lowered while the inlet 11 of conduit 2 remains stationary and positioned to accept liquid guided therethrough by liquid barrier 4. The second conduit 2 is attached to a flexible connector 5 at connection point 6. The flexible connector 5 can be a rope, cable, chain or any other flexible connector capable of lifting outlet 12 and is attached to second conduit 2 by any conventional means. The other end of connector 5 is attached to means for lifting 7. Means for lifting 7 is electrically connected by insulated wire 8 to means for sensing 9 which is positioned upstream relative to outlet 12.

Figure 2:
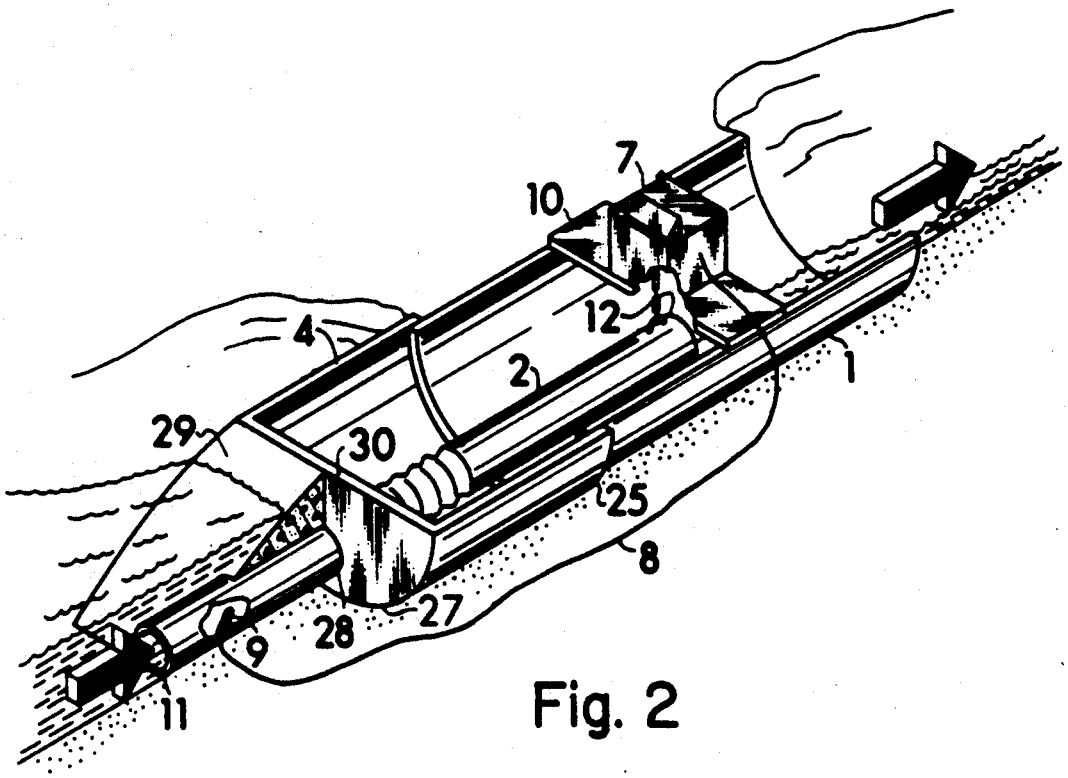
FIG. 2 is a perspective of an open drainage type automatic pollution containment and alert apparatus.

Examples of the first conduit as a closed structure are illustrated in FIGS. 1, 3, 4, 5, 7 and 8 where first conduit 1 is illustrated as a culvert. FIG. 2 illustrates an example of first conduit 1 as an open structure. In FIG. 2 first conduit 1 is a half-culvert and means for lifting 7 is attached to a lifting platform 10 to position lifting means 7 above second conduit 2. Neither the type of platform on which lifting means 7 is positioned nor is the location of lifting means 7 critical to this invention so long as means for lifting 7 raises outlet 12 in response to an electrical signal from sensing means 9.

Figure 3:
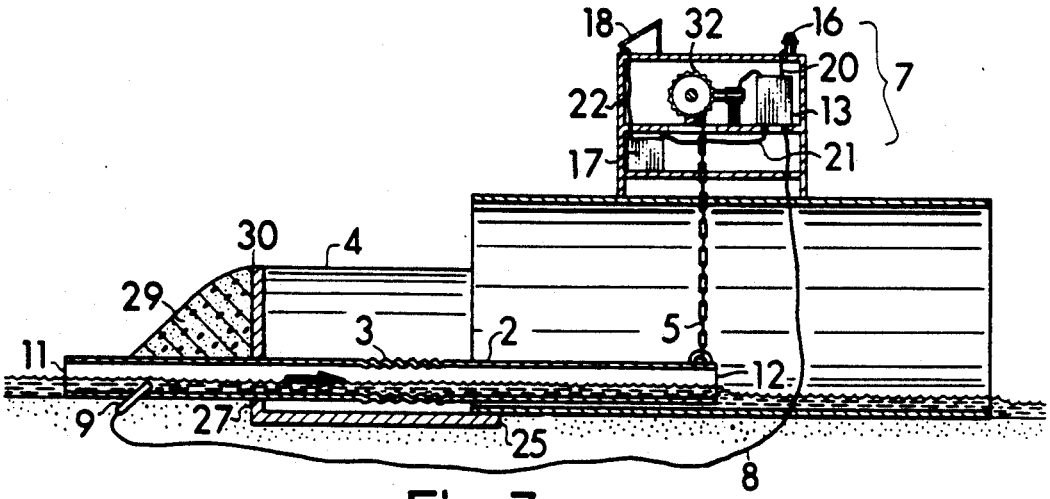
FIG. 3 is a partial cut-away side view showing normal liquid flow, when no pollution is detected by the automatic pollution containment and alert apparatus.
Figure 4:
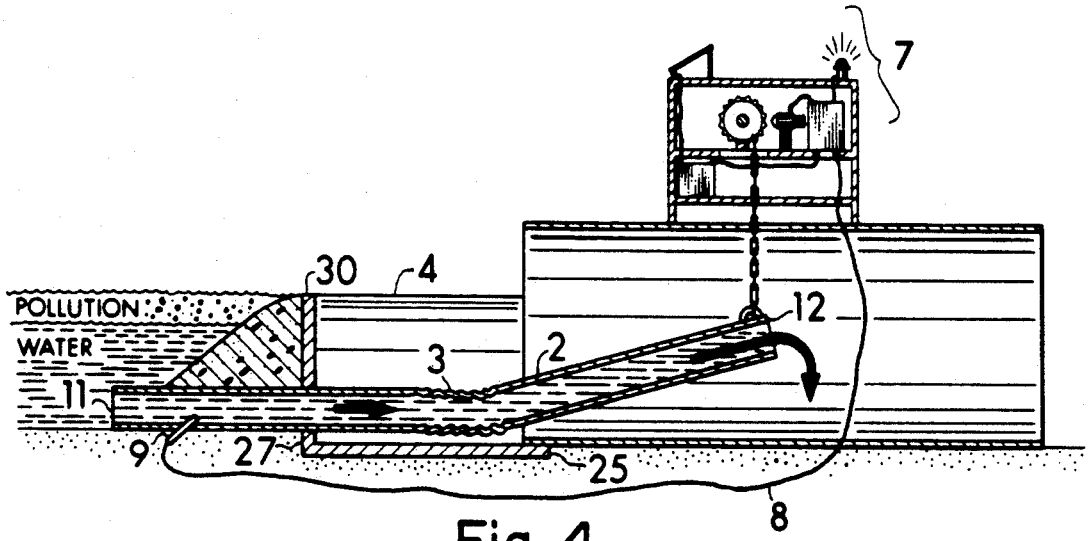
FIG. 4 is a partial cut-away side view showing normal liquid flow when pollution is detected by the automatic pollution containment and alert apparatus, and liquid flow is permitted.
Figure 5:
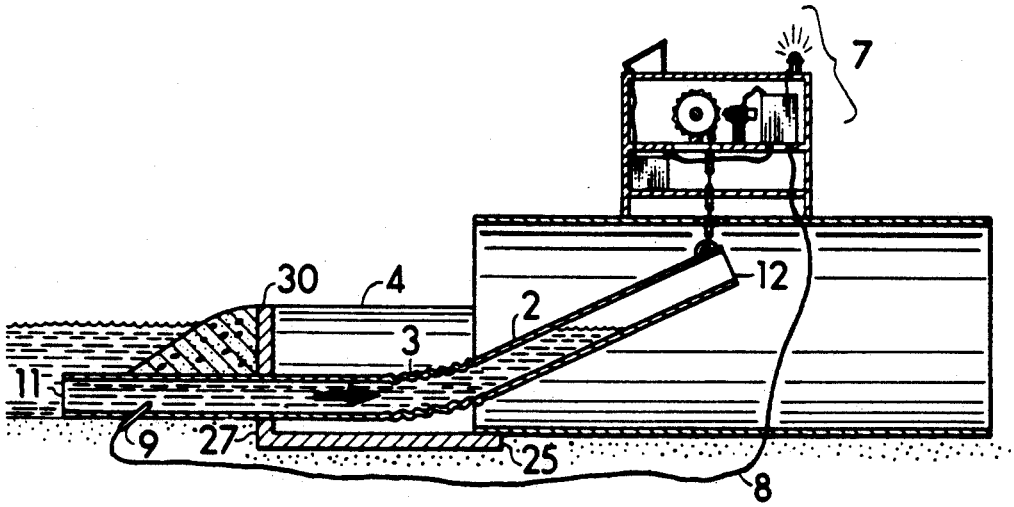
FIG. 5 is a partial cut-away side view showing normal liquid flow when pollution is detected by the automatic pollution containment and alert apparatus and liquid flow is not permitted.
Figure 7:
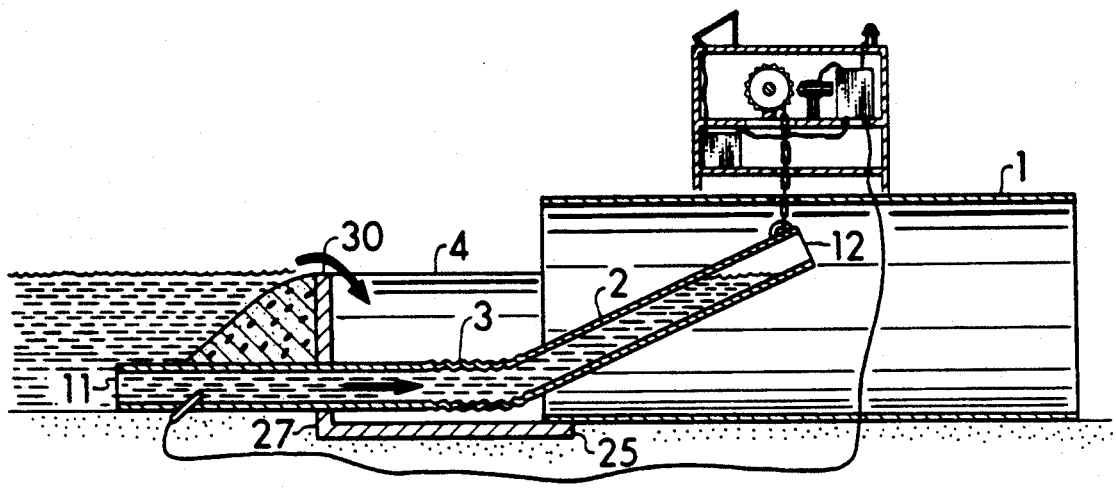
FIG. 7 is a partial cut-away side view showing breach of containment of liquid when pollution is detected.
Figure 8:
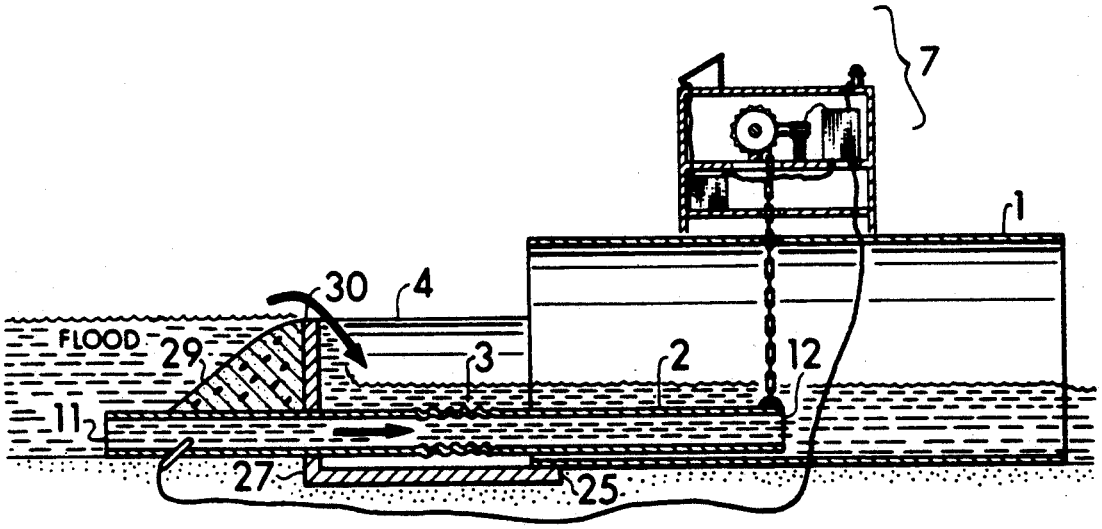
FIG. 8 is a partial cut-away side view showing flooding liquid flow through the automatic pollution containment and alert apparatus when no pollution is detected.

The liquid barrier 4 is illustrated in FIGS. 1 and 2 as a semi-cylinder with an open downstream end 25 and a semicircular solid inlet end 27. The barrier has a port 28 through which the second conduit 2 is positioned. The inlet 11 of second conduit 2 is secured to liquid barrier 4 by any means familiar to one skilled in the art to prevent leakage of liquid through the interface of port 28 and inlet 11. Gravel, rock, clay, concrete, cement, earth or other suitable material 29 can be located on the upstream surface of liquid barrier 4 to help reduce turbulence when flood conditions force fluid over the top 30 of liquid barrier 4 as shown in FIGS. 7 and 8. The liquid barrier 4 can have a different configuration than is illustrated in FIGS. 1-5, 7 and 8. The liquid barrier 4 can be a dam, dike, spillway, berm or any other means for temporarily restraining and for guiding liquid. Alternate configurations of liquid barrier 4 will remain within the scope of this invention so long as they perform the functions of guiding liquid into the second conduit 2 during normal flow (as shown in FIGS. 1, 2 and 3), restraining liquid behind barrier 4 when second conduit 2 is lifted during normal flow (as shown in FIGS. 4 and 5), and guiding liquid over the top 30 of liquid barrier 4 and into first conduit 1 and into second conduit 2 during loss of pollution containment (as shown in FIG. 7) or during floods (as shown in FIG. 8).

Normal drainage flow is illustrated in FIG. 3. During normal flow the total volumetric liquid flow through the drainage does not exceed the maximum volumetric liquid flow capacity of the second conduit 2. The liquid flows into inlet 11 of second conduit 2, flows through liquid barrier 4, through flexible portion 3, exits second conduit 2 at outlet 12, enters first conduit 1, and continues downstream.

FIGS. 4 and 5 illustrate normal liquid flow when pollution is detected by sensing means 9. Sensing means 9 activates lifting means 7 by sending an electrical signal to lifting means 7 via insulated wire 8. The lifting means 7 responds to the signal by raising outlet 12 to a predetermined height halting liquid flow through second conduit 2 and causing liquid to be temporarily restrained behind liquid barrier 4. FIG. 4 illustrates the condition where outlet 12 is raised to a height less than the height of liquid barrier 4. This allows liquid levels to rise behind liquid barrier 4 until the liquid level restrained by liquid barrier 4 exceeds the height of raised outlet 12. When the liquid level behind barrier 4 exceeds the height of outlet 12, liquid will flow through second conduit 2 and exit outlet 12. Allowing flow through raised outlet 12 is advantageous when pollution is floating on the surface of a liquid such as oil floating on water. By allowing liquid flow through raised outlet 12, liquid can be drained from beneath the pollution, returning some flow to the drainage, while simultaneously containing the pollution. Although not illustrated, if pollution is sensed during flood conditions, and outlet 12 is raised to a height less than the height of liquid barrier 4, the total drainage liquid flow will be greater than the volumetric flow capacity of second conduit 2 with outlet 12 raised. Therefore, liquid levels will continue to rise behind liquid barrier 4 and will eventually flow over the top of liquid barrier 4 as well as flow through raised conduit 2. Under flood conditions, obviously, pollution containment will be temporary at best.

FIG. 5 illustrates the condition where outlet 12 is raised to a height greater than the height of barrier 4. This prevents liquid levels retained behind liquid barrier 4 from ever becoming equal in height to raised outlet 12, thereby shutting off liquid flow into first conduit 1. When outlet 12 is raised higher than liquid barrier 4, pollution is contained only until the holding capacity of the area upstream from barrier 4 is exceeded, causing liquid flow over the top 30 of barrier 4 and subsequent loss of pollution containment as shown in FIG. 7. Raising outlet 12 greater than the height of fluid barrier 4 is done when the pollution detected in not floating on a liquid surface, and it is therefore desirable to contain the entire liquid flow behind barrier 4.

To prevent flooding of the area upstream from liquid barrier 4 and to prevent the force of the flood waters from repositioning or destroying the automatic pollution containment and alert apparatus, the invention operates as illustrated in FIG. 8. During flood conditions, the maximum liquid flow capacity of the second conduit 2 is exceeded causing the liquid level to rise behind liquid barrier 4. As the retained liquid rises, liquid barrier 4 guides the flooding liquid over the top 30 of liquid barrier 4 and guides some portion of the total flow into second conduit 2. The overflow from liquid barrier 4 bypasses second conduit 2, flows through first conduit 1 and continues downstream while the flow into second conduit 2 exits outlet 12, flows through first conduit 1 and continues downstream. As is obvious from FIG. 8, during flood conditions no pollution containment is possible even if outlet 12 were to be raised due to the volume of liquid flow surpassing the containment capacity of liquid barrier 4.

Figure 6:
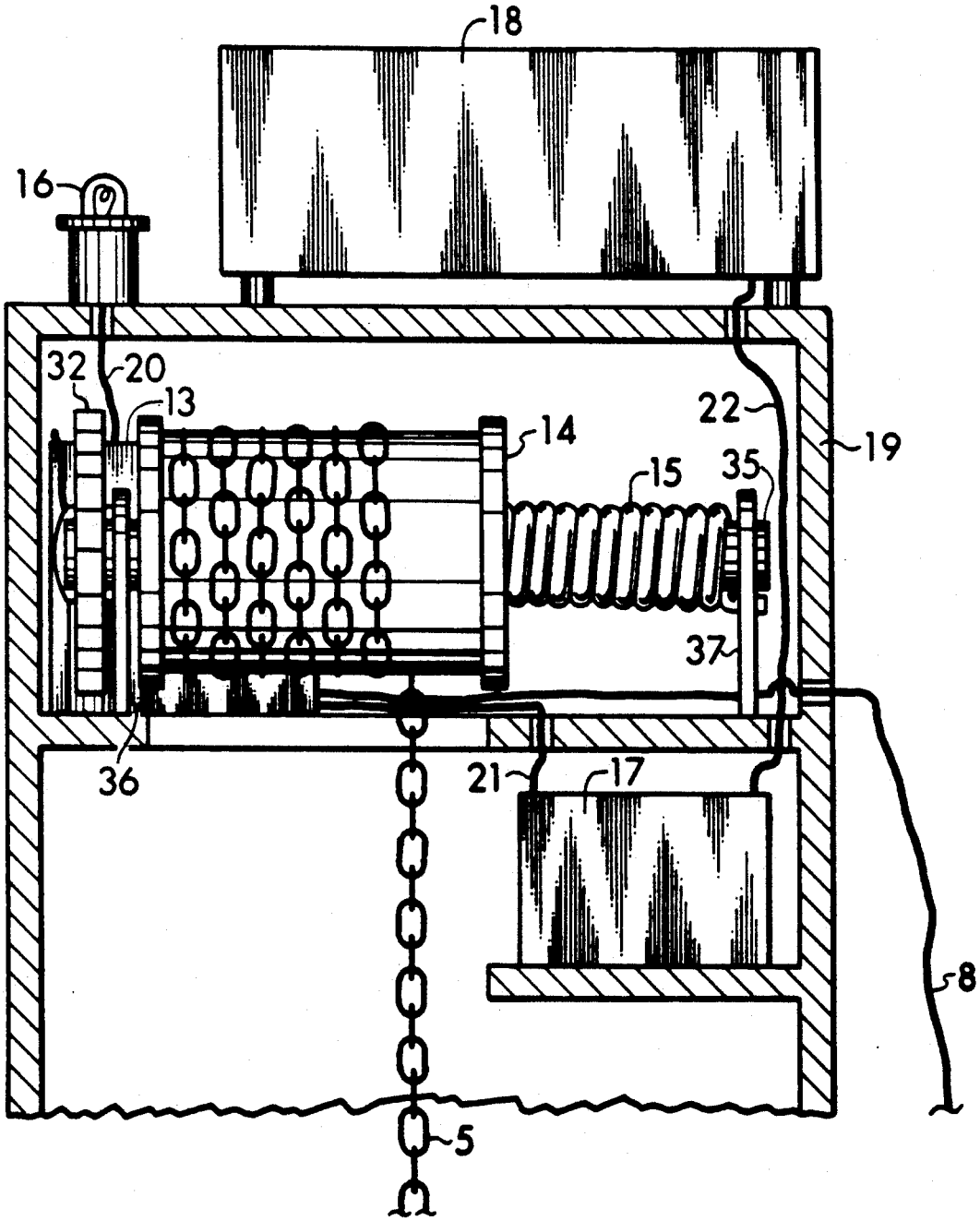
FIG. 6 is a partial cut-away frontal view of the means for lifting.
Figure 9:
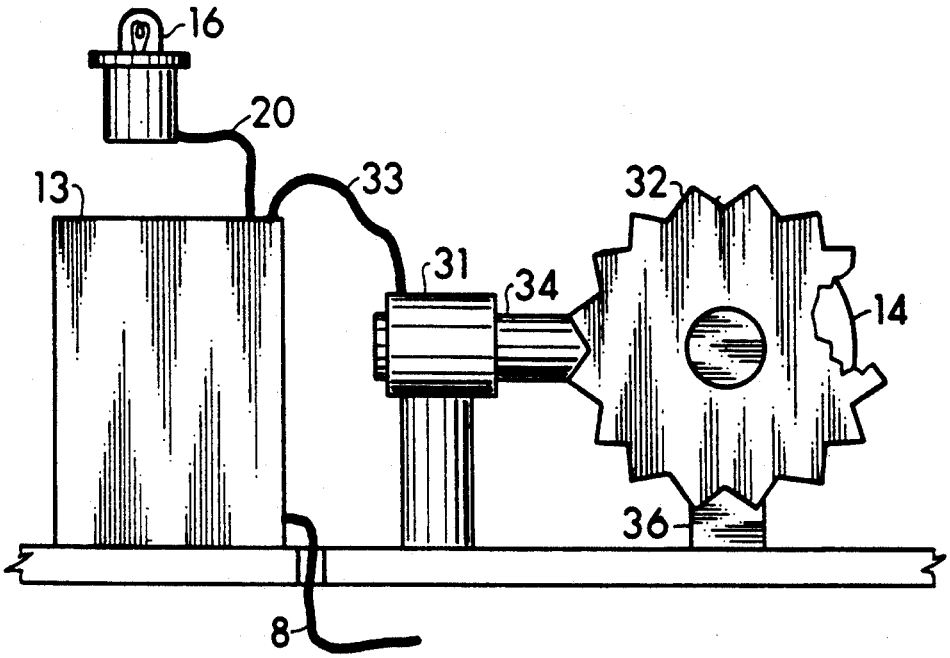
FIG. 9 is a partial cut-away side view of the means for lifting showing the solenoid latch closed.
Figure 10:
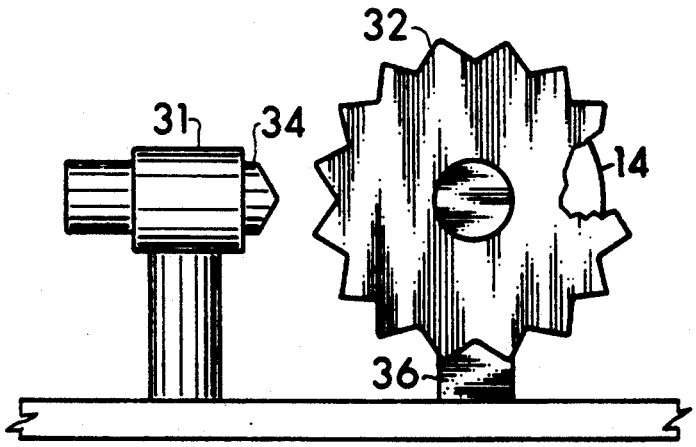
FIG. 10 is a partial cut-away side view of the means for lifting showing the solenoid latch open.

Lifting means 7 used to raise outlet 12 is illustrated in FIGS. 3, 6, 9 and 10. Lifting means 7 is comprised of an electronic controller 13, a solenoid latch 31, a winch 14 with a cogwheel 32, a spring 15, a winch shaft 35, shaft supports 36 and 37, an alarm 16, a battery 17, a solar charger 18, a housing 19, and wires 33, 20, and 22. When pollution is not sensed, solenoid latch 31 engages cogwheel 32 by pin 34 as shown in FIG. 9. When pollution is sensed by sensing means 9, lifting means 7 operates as follows, sensor 9 sends a signal through insulated wire 8 to controller 13. Controller 13 sends a signal through insulated wire 33 to solenoid latch 31 which retracts pin 34 from cogwheel 32 as shown in FIG. 10. Retraction of pin 34 from cogwheel 32 releases the tension on spring 15 which rotates winch 14 and winds flexible connector 5 on winch 14, raising outlet 12. For purposes of illustration only cogwheel 32 and winch 14 are shown fixably mounted on shaft 35. However, it is within the scope of this invention that the mounting arrangement of the cogwheel, the winch and the spring be different than is illustrated in FIG. 6 so long as retraction of pin 34 from cogwheel 32 causes spring 15 to wind connector 5 onto winch 14. The height outlet 12 is raised as determined by the amount of tension put on spring 15. Adjusting the tension on spring 15 allows outlet 12 to be raised to a height either less than, equal to or greater than the height of liquid barrier 4. Adjusting the tension on spring 15 is only one means to control the height of outlet 12. Other devices not shown in the drawings can be used to control the height of outlet 12 and still remain within the scope of this invention so long as the height of outlet 12 is adjustably controlled. These devices are inclusive of, but not limited to devices such as a stop on winch 14 or a stop on flexible connector 5. Controller 13 is powered by the electricity stored in solar charged battery 17 via wire 21. Controller 13 provides power to sensing means 9 via wire 8, if sensing means 9 requires electrical power to operate. Controller 13 also provides power to alarm 16 via wire 20 when sensing means 9 activates lifting unit 7. Alarm 16 is either an audio or visual alarm or both, which alerts personnel of pollution conditions. Solar charger 18 charges battery 17 through wire 22 allowing controller 13 and alarm 16 to operate continuously. Housing 19 encloses controller 13, solenoid latch 31, cogwheel 32, winch 14, spring 15, shaft 35, shaft supports 36 and 37, battery 17, and wires 20, 21, 22, and 33 to protect them from the elements. Solar charger 18 and alarm 16 are located outside of housing 19. For convenience of description, FIGS. 1 through 8 depict the elements of lifting means 7 atop or contained within housing 19. However, it is within the scope of this invention that the location and spatial arrangement of the elements of lifting means 7 be different than as depicted in FIGS. 1 through 8 so long as lifting means 7 performs the function of raising outlet 12 of second conduit 2 when sensing means 9 senses pollution.

The following examples describe the manner and process of using the present invention and sets forth the best mode contemplated by the inventor of carrying out the invention but is not to be confused as limiting the scope thereof.

EXAMPLE 1

An automatic pollution containment and alert apparatus (APCAA) is constructed on a small stream flowing adjacent to a crude oil storage tank. The APCAA is located downstream from the storage tanks. When an accidental oil spill from the storage tanks occurs, the APCAA hydrocarbon sensing means detects the presence of hydrocarbon in the stream water and sends a signal to the APCAA lifting means. The lifting means responds to the signal by lifting the outlet of the second conduit to a predetermined height, less than the height of the liquid barrier, while simultaneously flashing a light beacon and sounding an audible warning horn. The stream water with oil floating on its surface is not immediately able to flow through the raised outlet of the second conduit so the water level rises behind the liquid barrier. When the water level behind the liquid barrier exceeds the height the second conduit outlet is raised, the water behind the liquid barrier begins to flow into the inlet of the second conduit and out the raised outlet of the second conduit, thereby allowing some stream flow. By virtue of the fact that oil floats on water the spilled oil remains trapped behind the APCAA liquid barrier within the containment area, while the water beneath the oil flows through the port in the liquid barrier and into the second conduit. The audio and visual alarms alert personnel that a spill has occurred, allowing clean-up measures to be taken.

EXAMPLE 2

An APCAA is constructed on a small stream flowing adjacent to a hydrochloric acid storage tank. The APCAA is located downstream from the storage tank. When an acid spill from the storage tank occurs, the APCAA pH sensing means detects the presence of acidic conditions in the stream water and sends a signal to the APCAA lifting means. The lifting means responds to the signal by lifting the outlet of the second conduit to a predetermined height equal to or greater than the height of the liquid barrier, while simultaneously flashing a light beacon and sounding an audible warning horn. The acidified stream water is not able to flow through the raised outlet of the second conduit so the water level behind the liquid barrier rises, effectively containing the acid spill while alerting personnel that a spill has occurred and that remediation measures need to be taken.

Obviously, as can be seen from Examples 1 and 2 the liquid contained behind the liquid barrier in either example will not stay contained forever. The length of time a spill can be contained depends on the volume of liquid flow down the drainage, volume of spilled material and the volumetric holding capacity of the containment area behind the liquid barrier. However, with proper design and planning the APCAA can effectively contain spilled materials within a drainage long enough for personnel to be alerted and remediation measures to be enacted thereby preventing pollution spread downstream.

This invention is useful in any situation in which it is desired to contain undesirable materials within a liquid drainage. By use of an appropriate sensing means, such as a hydrocarbon sensor, a pH sensor, a liquid sensor for sensing liquid spills in dry drainages or a temperature sensor for sensing hot or cold liquid spills, virtually any undesirable material can be temporarily prevented from flowing down a drainage until remediation measures can be enacted.

While the preferred embodiments have been fully described and depicted for the purpose of explaining the principles of the present invention, it will be appreciated by those skilled in the art that modification, substitutions and changes may be made thereto without departing from the scope of the invention set forth in the appended claims.

I claim:

1. An apparatus for containing pollution within a liquid drainage, said apparatus comprising:

a) a first conduit for conveying liquid;

b) a second conduit comprising a tube having a liquid outlet and a liquid inlet, said liquid outlet being positioned within said first conduit;

c) a liquid barrier means for temporarily restraining and for guiding the flow of said liquid, said barrier means being connected to said second conduit;

d) means for lifting said liquid outlet of said second conduit relative to said liquid inlet, said lifting means being connected to said liquid outlet of said second conduit; and e) means for sensing pollution, said means for sensing being operatively connected to said lifting means so as to activate said lifting means in response to sensing said pollution.

2. The apparatus of claim 1 wherein at least a portion of said second conduit is flexible.

3. The apparatus of claim 1 wherein said second conduit is relatively smaller in diameter than said first conduit.

4. The apparatus of claim 1 wherein said means for lifting is comprised of:

a) an electronic controller, electrically connected to said sensing means, for receiving an activation signal from said sensing means;

b) a solenoid latch electrically connected to and powered by said controller, said solenoid latch having a pin retractable in response to power from said controller;

c) a cogwheel detachably connected to said pin;

d) a winch connected to said cogwheel;

e) a coil spring attached to said winch;

f) a shaft on which is mounted said cogwheel, said winch, and said coil spring;

g) an alarm electrically connected to and powered by said controller;

h) a battery electrically connected to said controller for powering said controller;

i) a solar charger electrically connected to said battery for charging said battery;

j) a flexible connector means attached at one end to said winch and attached at the other end to said liquid outlet of said second conduit;

k) a housing covering, coil spring, cogwheel, solenoid latch, shaft and outside of which are positioned said solar charger and said alarm.

5. The alarm of claim 4 wherein said alarm is an audio alarm.

6. The alarm of claim 4 wherein said alarm is a visual alarm.

7. The alarm of claim 4 wherein said alarm is an audio and a visual alarm.

8. The apparatus of claim 1 wherein said means for sensing is capable of sensing hydrocarbons.

9. The apparatus of claim 1 wherein said means for sensing is capable of sensing pH.

10. The apparatus of claim 1 wherein said means for sensing is capable of sensing temperature.

11. The apparatus of claim 1 wherein said means for sensing is capable of sensing hydrocarbons, pH, and temperature.

12. The apparatus of claim 1 wherein said means for sensing is capable of sensing a liquid.

13. The apparatus of claim 1 wherein said means for lifting is adjustable to vary the amount of lifting applied to said liquid outlet of said second conduit.

14. An apparatus for containing pollution within a liquid drainage, said apparatus comprising:

a) a first conduit for conveying liquid;

b) a second conduit having a liquid outlet and a liquid inlet, said liquid outlet being positioned within said first conduit;

c) a liquid barrier means for temporarily restraining and for guiding the flow of said liquid, said barrier means being connected to said second conduit;

d) means for lifting said liquid outlet of said second conduit relative to said liquid inlet; and e) means for sensing one or more of hydrocarbon, temperature and pH said sensing means being operatively connected to said means for lifting and being positioned upstream relative to said lifting means.

* * * * *

UNITED STATES PATENT AND TRADEMARK OFFICE

CERTIFICATE OF CORRECTION

PATENT NO. : 5,160,036

DATED : November 3, 1992

INVENTOR(S) : Charles P. Childers

It is certified that error appears in the above-identified patent and that said Letters Patent is hereby corrected as shown below:

Col. 8, line 56: After "covering" insert --said battery--.

Signed and Sealed this

Twenty-sixth Day of October, 1993

*Attest:*

Bruce Lehman

BRUCE LEHMAN

*Attesting Officer*

*Commissioner of Patents and Trademarks*